US006546749B1

(12) United States Patent
Canty

(10) Patent No.: US 6,546,749 B1
(45) Date of Patent: Apr. 15, 2003

(54) PIECE OF JEWELRY

(75) Inventor: Jesse Ben Canty, London (GB)

(73) Assignee: Jess James Limited (GB)

( * ) Notice: Subject to any disclaimer, the term of this patent is extended or adjusted under 35 U.S.C. 154(b) by 0 days.

(21) Appl. No.: 09/485,327

(22) PCT Filed: Aug. 5, 1998

(86) PCT No.: PCT/GB98/02342

§ 371 (c)(1),
(2), (4) Date: Apr. 21, 2000

(87) PCT Pub. No.: WO99/07245

PCT Pub. Date: Feb. 18, 1999

(30) Foreign Application Priority Data

Aug. 8, 1997 (GB) ..... 9716895
Jun. 17, 1998 (GB) ..... 9813105

(51) Int. Cl.[7] ..... A44C 5/00
(52) U.S. Cl. ..... 63/3; 63/15; 63/15.4; 63/31
(58) Field of Search ..... 63/3, 15, 15.4, 63/31; 446/170, 489, 236, 171; 273/153 S

(56) References Cited

U.S. PATENT DOCUMENTS

| | | | | | |
|---|---|---|---|---|---|
| 1,324,524 | A | * | 12/1919 | Silver | 235/123 |
| 2,060,345 | A | | 11/1936 | Phillips | |
| 2,332,344 | A | | 10/1943 | Roskin | |
| 2,653,402 | A | * | 9/1953 | Bonagura | 40/662 |
| 3,995,447 | A | | 12/1976 | Levsunov | 63/1 |
| 4,294,084 | A | * | 10/1981 | Lampert | 63/15 |
| 4,484,744 | A | * | 11/1984 | Gmunder | 273/153 S |
| 4,553,754 | A | * | 11/1985 | Wiggs et al. | 273/153 S |
| 4,841,746 | A | | 6/1989 | Chen | 63/15 |
| 4,977,757 | A | | 12/1990 | Mesica et al. | 63/15 |
| 5,110,130 | A | * | 5/1992 | Aulicino | 273/153 S |
| 5,121,614 | A | | 6/1992 | Weiss | 63/2 |
| 5,170,537 | A | | 12/1992 | Sperling | 24/136 |
| 5,228,316 | A | * | 7/1993 | Meyrowitz | 63/15.4 |
| 5,429,364 | A | * | 7/1995 | Chang | 273/153 S |
| 5,758,945 | A | * | 6/1998 | Lima | 362/84 |
| 5,896,757 | A | * | 4/1999 | Kharloubian | 63/31 |
| 6,065,971 | A | * | 5/2000 | Lennon | 434/246 |

FOREIGN PATENT DOCUMENTS

| | | |
|---|---|---|
| FR | 518718 | 5/1921 |
| FR | 2344245 | 10/1977 |
| FR | 2376638 | 8/1978 |
| FR | 2539597 | 7/1984 |
| GB | 2101897 | 1/1983 |
| GB | 2181939 | 5/1987 |
| GB | 2276806 | 10/1994 |
| WO | 9859196 | 12/1998 |

* cited by examiner

*Primary Examiner*—J. J. Swann
*Assistant Examiner*—Andrea Chop
(74) *Attorney, Agent, or Firm*—Ostrolenk, Faber, Gerb & Soffen, LLP

(57) ABSTRACT

A piece of jewelry comprising a substantially rigid base member comprising a groove along its length and a plurality of beads retained within the groove wherein the shape of the groove conforms to the shape of each bead to limit transverse movement of he beads and to allow the beads to slide along the groove. An outer member over a groove in the beads in turn holds the beads in the groove in the base member.

8 Claims, 2 Drawing Sheets

PIECE OF JEWELRY

BACKGROUND OF THE INVENTION

The present invention relates to a piece of jewelry, in particular, but not exclusively, it relates to a ring or bracelet.

It is very common that a wearer of jewelry fiddles with the jewelry. This has great comfort value to some people that can be therapeutic helping to relief stress etc. Commonly known types of jewelry, which are designed for such a purpose, are beads carried in the Middle East, known as worry beads, or beads worn around the neck in Asia, known as Tibetan beads. Another type of jewelry which has great appeal is the three band Russian wedding ring. The ring is formed of three interlocking bands which the wearer can work around his/her finger moving the bands with respect to one another.

SUMMARY OF THE INVENTION

The present invention seeks to provide a piece of jewelry which is satisfying to fiddle with.

A piece of jewelry comprises a substantially rigid base member comprising a groove along its length and a plurality of beads retained within the groove wherein the shape of the groove conforms to the shape of each bead to prevent transverse movement of the beads and to allow the beads to slide along the groove, the beads being retained by an outer member which engages a groove in each of the beads.

In this way an attractive piece of jewelry can be made which allows beads to be fiddled within one direction only, namely along a groove.

The shape of the groove is preferably such that the base member does not overlap the outer surface of each bead. The outer surface of the side walls of the groove and beads may be curved to form a continuous curved surface to give an attractive finish.

The beads may be retained within the groove by inwardly projecting side walls of the groove holding the beads captive. Another alternative arrangement, would be a monorail arrangement along the base of the groove in the base member engaging a corresponding groove within the beads, the monorail and the groove in the beads being shaped so as to retain the beads on the monorail.

The outer member may be slideable with respect to the beads so that another component of the piece of jewelry is movable.

The inner surface of the side walls of the groove of the base member may be curved, or angled outwardly from the base of the groove.

Preferably, the base member has an annular shape and the beads may slide along the outer circumference of the base member and the outer member may also have an annular shape so that the base member and the outer member are concentric.

The beads may be made of the same material or made from at least two different materials, for example, different types of precious metals, or materials containing different quantities of gold so that the beads are of different colours. Further, the moveable pieces may be set with precious stones.

BRIEF DESCRIPTION OF THE DRAWINGS

Embodiments of the present invention will now be described with reference to the accompanying drawings, in which.

DESCRIPTION OF THE PREFERRED EMBODIMENTS

Figure 1:
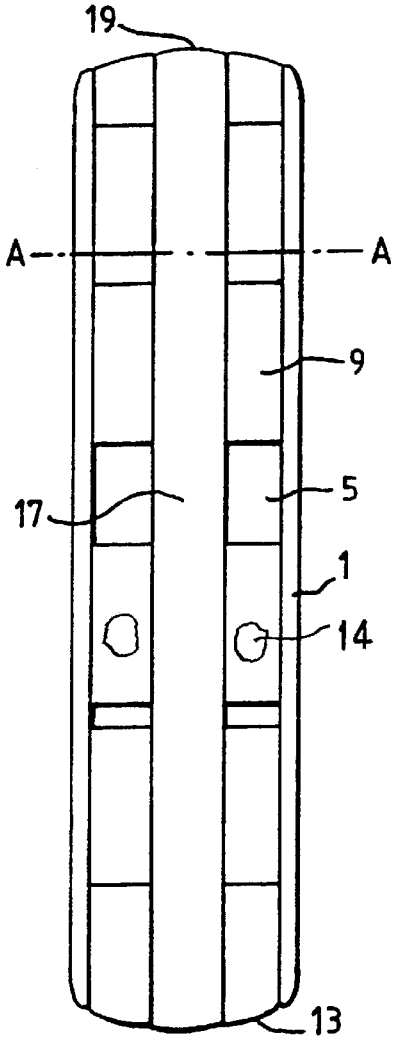
FIG. 1 shows a side view of a ring according to an embodiment of the present invention.

An embodiment of the present invention will be described with reference to the drawings which illustrate a ring. Of course, the invention may relate to any type of jewelry.

The ring comprises a substantially rigid base member 1 which has an annular shape of a size suitable to be worn on the finger. The ring may be formed of gold, silver, platinum or plastic or any other suitable material.

The base member 1 comprises an outer circumferential groove 3 having a substantially flat base 5 and opposing, outwardly-extending side walls 7. The side walls 7 slope outwardly from the base 5 of the groove 3 so as to provide an opening to the groove wider than the base 5.

The ring further comprises a plurality of movable pieces in the form of beads 9. Each bead comprises a substantially flat base 10 and opposing side walls 11. The side walls 11 slope outwardly from the base 10 to correspond to the shape of the groove 3 of the base member 1 so that the beads fit snugly in the groove without play in the transverse direction. This allows the beads to be easily inserted into the groove 3. The outer surface 13 of the bead 9 is curved. A precious stone, as at 14 in FIG. 1, may be set in one or more of the beads 9.

A groove 15 is formed in the outer surface 13 of each bead 9. The groove has a generally rectangular cross section.

The ring further comprises an outer member 17. The outer member 17 has an annular shape having a diameter greater than that of the base member 1. The cross section of the outer member 17 is generally rectangular so as to conform with the shape and dimensions of the groove 15 of the beads 9. The outermost surface 19 of the outer member 17 is curved.

Figure 2:
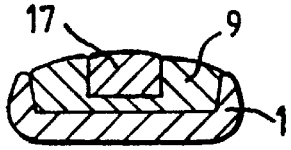
FIG. 2 shows a section taken along the line A—A of the ring in FIG. 1.
Figure 4:
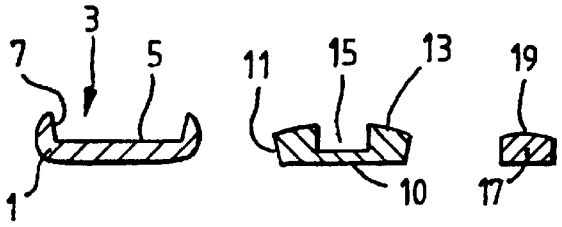
FIG. 4 shows a section taken along the line B—B of the components of FIG. 3.
Figure 3:
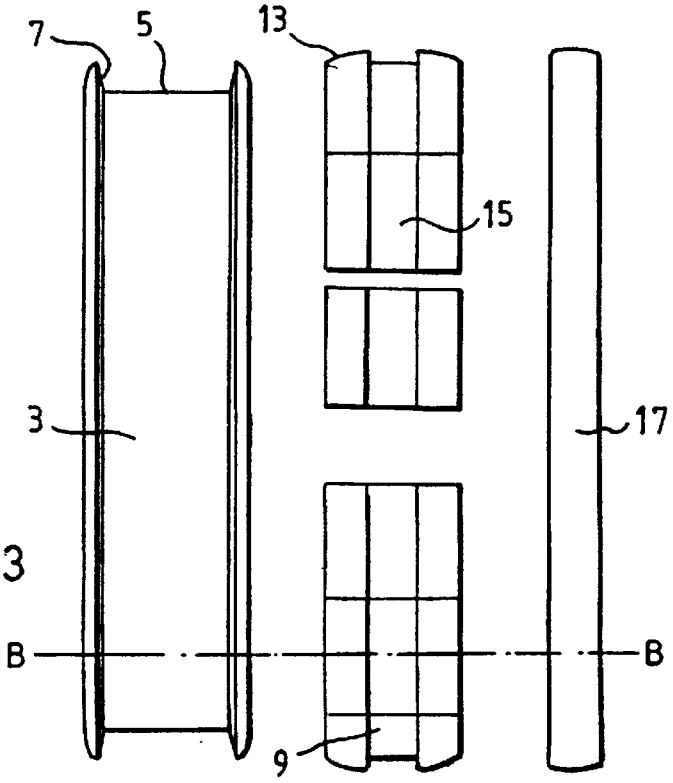
FIG. 3 shows a side view of the separated components of the ring of FIG. 1.

To form the composite ring of FIGS. 1 and 2 from the components shown in FIGS. 3 and 4, the beads 9 are placed within the groove 3 of the base member 1 so that the outer surface 13 faces outermost. The number of beads placed within the groove 3 are such that they do not completely fill the groove 3 in the circumferential direction. Therefore, the beads 9 can freely move along the groove 3 of the base member 1 as far as adjacent beads will allow.

The outer member 17 is placed within the groove 15 of the beads 9 to retain the beads within the groove 3 of the base member 1. This is achieved by forming the outer member 17 having a diameter such that it fits over the beads 9 in the groove 3 and is compressed into the groove 15 of the beads 9 as shown in FIG. 4. Since the outermost surface 19 of the outer member 17 is curved, when it is placed within the groove 15 of the beads 9, the outermost surface of the composite ring has a substantially continuous curved surface formed by the outer surface 13 of the beads 9 and the outer surface 19 of the outer member 17.

Figure 5:
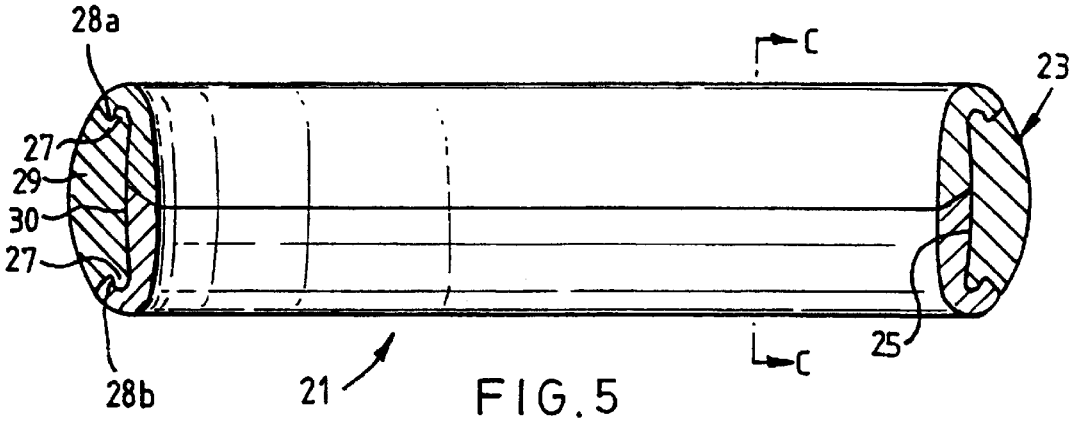
FIG. 5 shows a part section of a ring according a second embodiment of the present invention.
Figure 6:
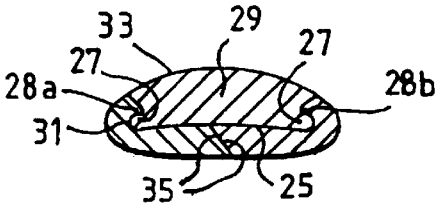
FIG. 6 shows a section along the line C—C of the part of FIG. 5.

FIGS. 5 and 6 show a part of a ring according to a second embodiment of the present invention. The ring comprises an annular-shaped base member 21. The base member base 21 comprises a circumferential groove 23. The groove 23 comprises a base 25 which is curved and opposing side walls 27. Each side wall comprises a protrusion 28*a* which extends inwardly to form an undercut 28*b*.

A plurality of beads 29 are provided. Each bead 29 comprises a base 30 which curved to complement the curved beads 25 of the groove 23 of the base member 21. Each bead 29 also comprises side walls 31 which are shaped to conform to the shape of the side walls 27 of the groove 23 of the base member 21 so that the beads fit into the undercut 28*b*. The outer surface 33 of each bead 29 is curved.

The beads 29 are placed into the groove 23 of the base member 21. This is achieved by forming the base member 21 in two halves. The halves are formed by dividing the ring along its circumference at an angle to produce two oblique surfaces 35. The two halves are placed together so that the oblique surfaces met with the beads in the groove 23. The two halves can then be soldered together to form the composite ring.

As described with reference to the first embodiment, the beads are held captive within the groove of the base member, in this case by means of the undercut 28*b*. The beads, therefore, fit snugly in the groove without play in the transverse direction. The number of beads placed within the groove 23 of the base member 2 are such that they do not completely fill the groove 23 in the circumferential direction. Therefore, the beads 29 freely move along the groove 23 as far as adjacent beads will allow.

Figure 7:
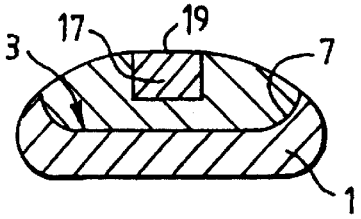
FIG. 7 shows a cross section of a ring according to a third embodiment of the present invention.

FIG. 7 shows an alternative to the ring of the first embodiment in which the side walls 7 of the groove 3 are not vertical as in the first embodiment but are curved. Further the outer surface 19 of the outer member 17 may be flat instead of curved.

Therefore when worn, the composite ring as described above provides movable pieces (beads) which can be moved around the outside of the ring by the wearer. These movable pieces are slideable along the groove and the outer member is also slideable with respect to the remaining components.

Figure 8:
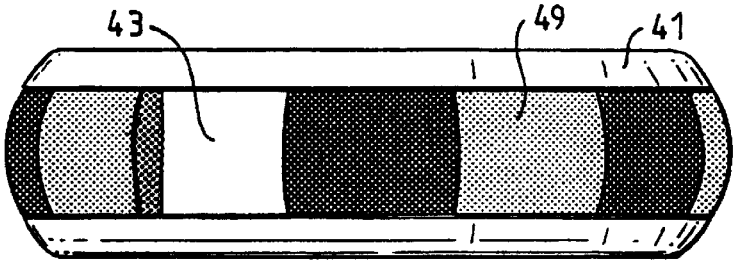
FIG. 8 shows a side view of a ring according to a fourth embodiment of the present invention.
Figure 9:
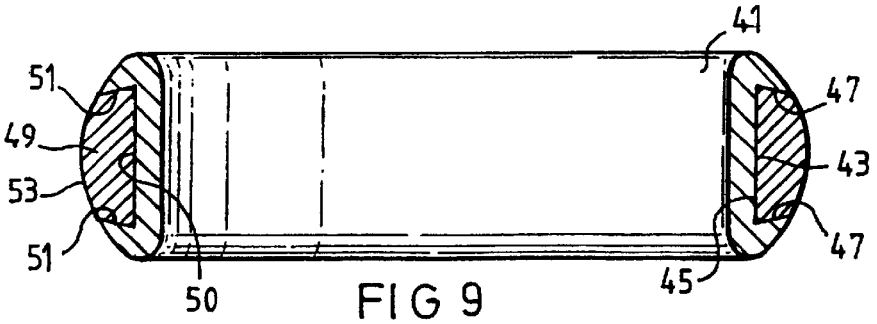
FIG. 9 shows a part section of the ring of FIG. 8.

FIGS. 8 and 9 show a fourth embodiment of the present invention. The ring comprises an annular shaped base member 41. The base member 41 has a circumferential groove 43. The groove 43 has a base 45 which is substantially flat and opposing side walls 47. Each side wall 47 slopes inwardly as it extends from the base 45.

A plurality of beads 49 are provided. Each bead 49 has a base 50 which is substantially flat and side walls 51 which slope inwardly so that the shape of the bead conforms to the shape of the groove 43 of the base member 41. The outer surface of the side walls 47 of the groove 43 and the outer surface 53 of each bead 49 are curved to form a continuous curved surface and the side walls 47 of the groove 43 do not overlap the outer surface 53 of the bead 49.

The ring is formed by forming the groove 43 in the base member 41 with the side walls 47 of the groove 43 being substantially perpendicular to the base 45 of the groove 43. The beads 49 are placed into the groove 43. The side walls 47 are then shaped to conform to the shape of the beads. This can be achieved by use of a known technique utilizing lasers.

The inwardly sloping side walls 47 of the groove 43 hold the beads captive within the groove so that the beads fit snugly without play in the transverse direction. The number of beads placed within the groove 43 are such that they do not completely fill the groove 43 in the circumferential direction. Therefore, the beads 49 freely move along the groove 43 as far as adjacent beads will allow.

The beads may be formed of at least two different materials, for example materials containing different quantities of gold so that the beads are different colors. The outer member and base member may also be formed of different materials. The components of the ring may be formed of different colored plastics or be formed of a transparent plastic. The base member, beads or outer member may be set with precious stones. The outermost surface of the ring may be textured.

In the light of this disclosure, modifications of the described embodiments as well as other embodiments, all within the scope of the appended claims will now become apparent to a person skilled in the art.

What is claimed is:

1. A piece of jewelry comprising a substantially rigid base member comprising a first groove along its length, and a plurality of beads retained within the first groove, wherein the shape of the first groove conforms to the shape of each bead to prevent transverse movement of the beads and to allow the beads to slide along the first groove, each bead having a bead groove which is outward of the first groove at the base member, an outer member outward of the beads for retaining the beads by the outer member engaging the bead groove in each of the beads to hold the beads captive within the first groove of the base member;

the base member has an annular shape, the first groove and the bead groove both open outward and the beads slide along an outer circumference of the base member in the first groove; and the outer member has an annular shape, and the base member and the outer member are concentric.

2. A piece of jewelry according to claim 1, wherein the first groove is of a size and shape such that the base member does not overlap the outer surface of each bead.

3. A piece of jewelry according to claim 1, wherein the first groove is defined by spaced side walls of the base member, the side walls having outer surfaces outward of the first groove and the outer surfaces end in beads that are curved to form a continuous curved surface.

4. A piece of jewelry according to claim 1, wherein the outer member is slidable with respect to the beads.

5. A piece of jewelry according to claim 1, wherein the beads are formed from at least two different materials.

6. A piece of jewelry according to claim 1, wherein at least one of the beads is set with a precious stone.

7. A piece of jewelry according to claim 1, wherein the piece of jewelry is a ring to be worn on the finger.

8. A piece of jewelry according to claim 1, wherein the piece of jewelry is a bracelet.

* * * * *